US010411392B2

(12) United States Patent
Manushi et al.

(10) Patent No.: US 10,411,392 B2
(45) Date of Patent: Sep. 10, 2019

(54) HYBRID ELECTRICAL CONNECTOR

(71) Applicant: Robert Bosch LLC, Broadview, IL (US)

(72) Inventors: Ligor Manushi, Northville, MI (US); Mario Reyes, Chihuahua (MX); Hiram Avalos, Detroit, MI (US); Mark Ryskamp, Grosse Pointe Park, MI (US); Allison McInnis, Detroit, MI (US); Jens Oberender, Boebiugen An der Rams (DE); Michael Schoenfeld, Leinfelden-Echterdingen (DE); Alexander Moore, Ann Arbor, MI (US); Robert Keller, Walled Lake, MI (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/009,430

(22) Filed: Jun. 15, 2018

(65) Prior Publication Data

US 2018/0294594 A1 Oct. 11, 2018

Related U.S. Application Data

(62) Division of application No. 15/436,965, filed on Feb. 20, 2017, now Pat. No. 10,027,051.

(51) Int. Cl.

| | |
|---|---|
| ***H01R 13/504*** | (2006.01) |
| ***H01R 13/405*** | (2006.01) |
| ***H01R 43/18*** | (2006.01) |
| ***H01R 43/24*** | (2006.01) |
| ***H01R 13/52*** | (2006.01) |

(52) U.S. Cl.

CPC ..... *H01R 13/504* (2013.01); *H01R 13/405* (2013.01); *H01R 13/5202* (2013.01); *H01R 43/18* (2013.01); *H01R 43/24* (2013.01); *H01R 13/5219* (2013.01)

(58) Field of Classification Search

USPC ..... 439/695

See application file for complete search history.

(56) References Cited

U.S. PATENT DOCUMENTS 5,078,626 A * 1/1992 Matsuoka ..... H01R 12/714 439/140
5,362,261 A * 11/1994 Puerner ..... H01R 13/4364 439/689
5,387,119 A * 2/1995 Wood ..... H01R 13/523 439/281

(Continued)

*Primary Examiner* — Alexander Gilman
(74) *Attorney, Agent, or Firm* — Kelly McGlashen; Maginot Moore & Beck LLP

(57) ABSTRACT

A hybrid electrical connector includes a housing having a central opening, a carrier plate supported by the housing within the central opening, and electrically conductive pins supported within the housing by the carrier plate. The housing is formed of a first plastic material, and the carrier plate is formed of a second plastic material having properties that make it more dimensionally stable than the first plastic material. In addition, a sealing layer is applied to one surface of the carrier plate, the sealing layer formed of a third plastic material and serving to secure the carrier plate to the housing and to secure the pins within the carrier plate. A method of forming the electrical connector is also described.

7 Claims, 8 Drawing Sheets

(56) References Cited

U.S. PATENT DOCUMENTS 5,671,529 A * 9/1997 Nelson ..... A61B 5/14552 29/825
5,711,685 A * 1/1998 Wood ..... H01R 13/5221 439/587
5,777,850 A * 7/1998 Jakob ..... B60R 16/0239 361/736
5,934,913 A * 8/1999 Kodama ..... H01R 12/58 439/557
5,980,317 A * 11/1999 McNeel ..... H01R 13/502 439/281
6,095,698 A * 8/2000 Strab ..... G02B 6/3817 385/53
6,171,133 B1 * 1/2001 Altuner ..... H05K 3/306 439/374
6,261,105 B1 * 7/2001 Uezono ..... H01H 50/048 439/76.1
6,392,895 B2 * 5/2002 Taguchi ..... H05K 5/0069 361/736
6,413,119 B1 * 7/2002 Gabrisko, Jr. ..... H01R 13/719 439/620.05
6,443,745 B1 * 9/2002 Ellis ..... H01R 23/688 439/101
6,500,027 B1 * 12/2002 Van Der Sanden ..... H01R 13/5216 439/587
6,572,412 B2 * 6/2003 Beuther ..... H05K 5/0069 439/381
6,573,448 B2 * 6/2003 Mayer ..... H05K 5/0069 174/481
6,616,480 B2 * 9/2003 Kameyama ..... H01R 13/521 439/271
6,702,593 B2 * 3/2004 Ogawa ..... H01R 13/748 439/79
6,737,579 B1 * 5/2004 Laufer ..... F02M 41/125 174/50.52
6,755,677 B2 * 6/2004 Kamiya ..... H01R 43/205 439/381
6,821,135 B1 * 11/2004 Martin ..... H01R 13/629 439/141
6,830,465 B2 * 12/2004 Norris ..... H01R 13/518 439/75
6,870,096 B2 * 3/2005 Suzuki ..... H05K 7/026 174/50
6,981,316 B2 * 1/2006 Korczynski ..... B60R 16/0238 174/260
7,094,075 B1 * 8/2006 Lim ..... H01R 13/508 439/76.1
7,097,494 B1 * 8/2006 Eakins ..... H01R 13/422 439/475
7,110,246 B2 * 9/2006 Tsunooka ..... B60T 8/3675 361/637
7,165,979 B1 * 1/2007 Oka ..... H05K 3/306 439/381
7,189,081 B2 * 3/2007 Tanaka ..... B60R 16/0238 439/76.2
7,234,950 B1 * 6/2007 Wickett ..... H01R 13/504 439/247
7,341,484 B2 * 3/2008 Yamamoto ..... H01R 13/5202 439/271
7,396,254 B2 * 7/2008 Harmelink ..... H01R 13/518 439/540.1
7,603,770 B2 * 10/2009 Brandenburg ..... H05K 3/284 264/272.11
7,792,662 B2 * 9/2010 Grichnik ..... G06F 17/509 703/1
7,867,023 B2 * 1/2011 Keyser ..... H05K 5/0069 439/567
8,139,364 B2 * 3/2012 Wickett ..... H05K 5/061 174/50
8,187,007 B2 * 5/2012 Emde ..... H01R 12/585 439/751
8,292,639 B2 * 10/2012 Achammer ..... H01R 12/585 29/832
8,408,923 B2 * 4/2013 Tay ..... H01R 13/521 439/79
8,455,763 B2 * 6/2013 Dais ..... H01B 17/28 174/152 R
8,523,581 B2 * 9/2013 Martin ..... H01R 12/724 439/83
8,962,999 B2 * 2/2015 John ..... H01R 12/7023 174/59
9,065,222 B2 * 6/2015 Drew ..... H01R 12/71
9,101,066 B2 * 8/2015 Azumi ..... H05K 5/069
9,136,637 B2 * 9/2015 Genta ..... H01R 13/5208
9,179,560 B2 * 11/2015 Yoon ..... B60R 16/0238
9,277,664 B2 * 3/2016 Yoshino ..... H04R 1/00
9,320,165 B2 * 4/2016 Gruber ..... H05K 5/0069
9,622,355 B2 * 4/2017 Stern ..... H05K 3/30
9,653,853 B2 * 5/2017 Ohtani ..... H01R 13/665
2003/0162421 A1 * 8/2003 Pratt ..... H01R 13/6658 439/76.1
2005/0122694 A1 * 6/2005 Kane ..... H05K 5/0069 361/752
2005/0150674 A1 * 7/2005 Munoz ..... H01R 13/52 174/53
2005/0245130 A1 * 11/2005 Shiga ..... H01R 13/5208 439/587
2008/0045061 A1 * 2/2008 Hayashi ..... H01R 13/5202 439/246
2014/0045373 A1 * 2/2014 Kaesser ..... H01R 13/504 439/540.1
2015/0014887 A1 * 1/2015 Keitel ..... B29C 45/281 264/328.8
2015/0044903 A1 * 2/2015 Gruber ..... H05K 5/0069 439/540.1
2015/0188179 A1 * 7/2015 Suh ..... H01M 8/248 264/263
2016/0301177 A1 * 10/2016 Moran ..... H01R 43/24
2018/0183161 A1 * 6/2018 Soyano ..... H05K 1/142

* cited by examiner

HYBRID ELECTRICAL CONNECTOR

CROSS REFERENCE TO RELATED APPLICATIONS

This application is a divisional of U.S. patent application Ser. No. 15/436,965 entitled "Hybrid Electrical Connector", filed Feb. 20, 2017, which is hereby incorporated by reference in its entirety for all purposes.

BACKGROUND

A hybrid electrical connector is an electrical connector that contains contacts for more than one type of service. A hybrid electrical connector such as a smart data link connector (SDLC) may include only two different contact variants, for example electrically conductive pins of two different sizes. In some SDLCs, the pins are separate from the plastic used to form the housing, and the connector geometry is fully integrated into the housing by molding the pin holes prior to pin insertion. Since SDLCs may also include large arrays of closely arranged, small diameter pins, the housing must be manufactured with very high tolerances to provide sufficient pin positional tolerance required to enable accurate pin press-fit connection with, for example a printed circuit board (PCB).

It is desirable to form electrical connectors from plastic materials due to the relatively lower cost and lower weight of plastic materials relative to metal materials. However, plastic materials generally do not have the structural stability of metals. This is due in part to the tendency of plastic materials to absorb water and to have a high volumetric shrinkage. The chemistry of the plastic material can be controlled to provide materials having relatively low water absorption and relatively low volumetric shrinkage, but such plastics are expensive relative to some conventional plastics. As used herein, the term "highly dimensionally stable plastic" refers to a plastic that absorbs less than 0.05 percent water and has a volumetric shrinkage of less than 0.003 cm/cm.

In some hybrid electrical connectors, it is desirable to provide an additional pin variant, e.g., a third pin having a size that is different from the other two pin variants. In addition, it is desirable to provide a low cost, light weight electrical connector that has improved dimensional control of the housing to facilitate accurate pin positioning and alignment, providing reliable press fit connection between connector pins and a corresponding socket device for electrical connectors having large arrays of closely arranged, small diameter pins.

SUMMARY

In some aspects, an electrical connector includes a housing formed of a first plastic material, the housing having a central opening, and circumferentially extending housing connector ribs that protrude inward from an inner surface of the central opening. The electrical connector includes a carrier plate formed of a second plastic material, the carrier plate having a first surface, a second surface opposed to the first surface and joined to the first surface by a peripheral edge, a first array of holes that extend between the first surface and the second surface, and circumferentially extending carrier plate connector ribs that protrude outward from the peripheral edge and engage with the housing connector ribs. In addition the electrical connector includes a first set of electrically conductive pins, each pin of the first set of pins disposed in a corresponding one of the first array of holes. A sealing layer is disposed on the first surface of the carrier plate in such a way as to secure the carrier plate to the housing and to secure the first pins within the first holes, and the first plastic material has properties that make it more dimensionally stable than the second plastic material.

The electrical connector may have one or more of the following features: The carrier plate includes a second array of holes that extend between the first surface and the second surface. The electrical connector includes a second set of electrically conductive pins, each pin of the second set of pins disposed in a corresponding one of the second array of holes. The size of the pins that comprise the second set of pins is different than the size of the pins that comprise the first set of pins. The carrier plate includes a third array of holes that extend between the first surface and the second surface. The electrical connector includes a third set of pins, each pin of the third set of pins disposed in a corresponding one of the third array of holes, and the size of the pins that comprise the third set of pins is different than the size of the pins that comprise the first set of pins and the size of the pins that comprise the second set of pins. The first plastic material is different than the second plastic material, the sealing layer is formed of a third material, and the second plastic material is different from the third material. The first set of pins and the carrier plate are potted within the housing by the sealing layer. The second plastic material has water absorption properties of less than 0.05 percent, and may have a volumetric shrinkage of less than 0.003 cm/cm. The holes of the first array are arranged in rows, and an elongated channel is formed in the carrier plate first surface between adjacent rows. A standoff is disposed in the channel and protrudes in a direction normal to the carrier plate first surface, the standoff having a proximal end that is integrally formed with the carrier plate, and a distal end that is opposed to the proximal end and resides outside the channel. A guide element protrudes from the second surface in a direction normal to the second surface, the guide element being disposed between adjacent rows and elongated in a direction parallel to the rows. The housing comprises a base portion, a first tubular shroud and a second tubular shroud. The base portion has a base first side, a base second side that is opposed to the base first side, and a flange that is offset from the base portion and protrudes in a direction parallel to the base first and second sides. The first tubular shroud protrudes outwardly from the base first end, and an inner surface of the first shroud is aligned with the central opening. In addition, the second tubular shroud protrudes outwardly from the base second end, and an inner surface of the second shroud is coaxial with the first shroud and forms an extension of the central opening.

In some aspects, an electronic control device includes a housing including an opening, a printed circuit board disposed in the housing, and an electrical connector disposed in the opening. The electrical connector includes a housing formed of a first plastic material, the housing having a central opening, and circumferentially extending housing connector ribs that protrude inward from an inner surface of the central opening. The electrical connector includes a carrier plate formed of a second plastic material, the carrier plate having a first surface, a second surface opposed to the first surface and joined to the first surface by a peripheral edge, a first array of holes that extend between the first surface and the second surface, and circumferentially extending carrier plate connector ribs that protrude outward from the peripheral edge and engage with the housing connector ribs. In addition, the electrical connector includes a first set of electrically conductive pins, each pin of the first set of pins disposed in a corresponding one of the first array of holes. A sealing layer is disposed on the first surface of the carrier plate in such a way as to secure the carrier plate to the housing and to secure the first pins within the first holes, and the first plastic material has properties that make it more dimensionally stable than the second plastic material. In some embodiments, the pins are linear electrical conductors that extend in a direction normal to both the first surface and a surface of the printed circuit board.

In some aspects, a method of fabricating an electrical connector includes the following method steps: Providing electrically conductive pins arranged in an array in which each pin is spaced apart from and parallel to adjacent pins of the array; performing a first overmolding procedure on the pins in which a carrier plate is provided, the carrier plate formed of a first plastic material that supports the pins in the arrayed configuration; performing a second overmolding procedure on the carrier plate in which a housing is provided, the housing formed of a second plastic material and surrounding a periphery of the carrier plate in such a way that an outer periphery of the carrier plate engages an inner periphery of the housing; and following the second overmolding procedure, applying a sealing layer formed of a third plastic material to one side of the carrier plate in such a way as to seal the pins to the carrier plate and seal the carrier plate to the housing.

The method may include one or more of the following method steps and/or features: The first overmolding procedure is performed in a first apparatus, the second overmolding procedure is performed in a second apparatus, and the carrier plate is transferred between the first apparatus and the second apparatus following the first overmolding procedure, whereby cooling of the carrier plate occurs between the first overmolding procedure and the second overmolding procedure. The first overmolding procedure and the second overmolding procedure are performed in a first apparatus, and the carrier plate is remains in the first apparatus for both the first overmolding procedure and the second overmolding procedure, and the second overmolding procedure is performed immediately following the first overmolding procedure, whereby a portion of a first material used in the first overmolding procedure forms a chemical bond with a portion of a second material used in the second overmolding procedure. The array of pins is provided prior to the step of performing a first overmolding procedure on the pins whereby the carrier plate is formed with the array of pins in place. The array of pins is provided following the step of performing a second overmolding procedure on the carrier plate in which a housing is provided, and the pins are inserted into preexisting openings in the carrier plate.

The hybrid electrical connector disclosed herein includes three pin variants advantageously allowing electrical connections for an additional type of service as compared to some conventional two-pin electrical connectors.

The hybrid electrical connector disclosed herein includes a plastic housing, a plastic carrier plate supported within the housing and electrically conductive contacts in the form of pins. The carrier plate includes three arrays of holes that receive and support three variants of the electrically conductive pins. Advantageously, the carrier plate is formed of a highly dimensionally stable plastic so that the pins are accurately and reliably supported within the connector in the desired positions and orientations. The housing, whose dimensional stability is less critical, is formed of a conventional plastic. By forming the hybrid electrical connector of two different plastic materials, the desired pin configuration can be accurately and reliably provided, while overall costs of the hybrid electrical connector can be minimized.

The hybrid electrical connector disclosed herein includes the carrier plate formed of a first, highly dimensionally stable plastic material, and the housing formed of a second, conventional plastic material. The first plastic material and the second plastic material have different chemical compositions which make them difficult to bond together. For this reason, the connector includes features that facilitate secure joining of the carrier plate to the housing. In particular, the carrier includes surface features that cooperatively engage surface features of the housing whereby the carrier is securely fixed to the housing.

In addition, a third plastic material is applied to at least one side of the carrier. The third plastic material is a potting material, and is used to secure the pins within pin holes formed in the carrier plate, and to further secure the carrier plate to the housing.

DETAILED DESCRIPTION

Figure 1:
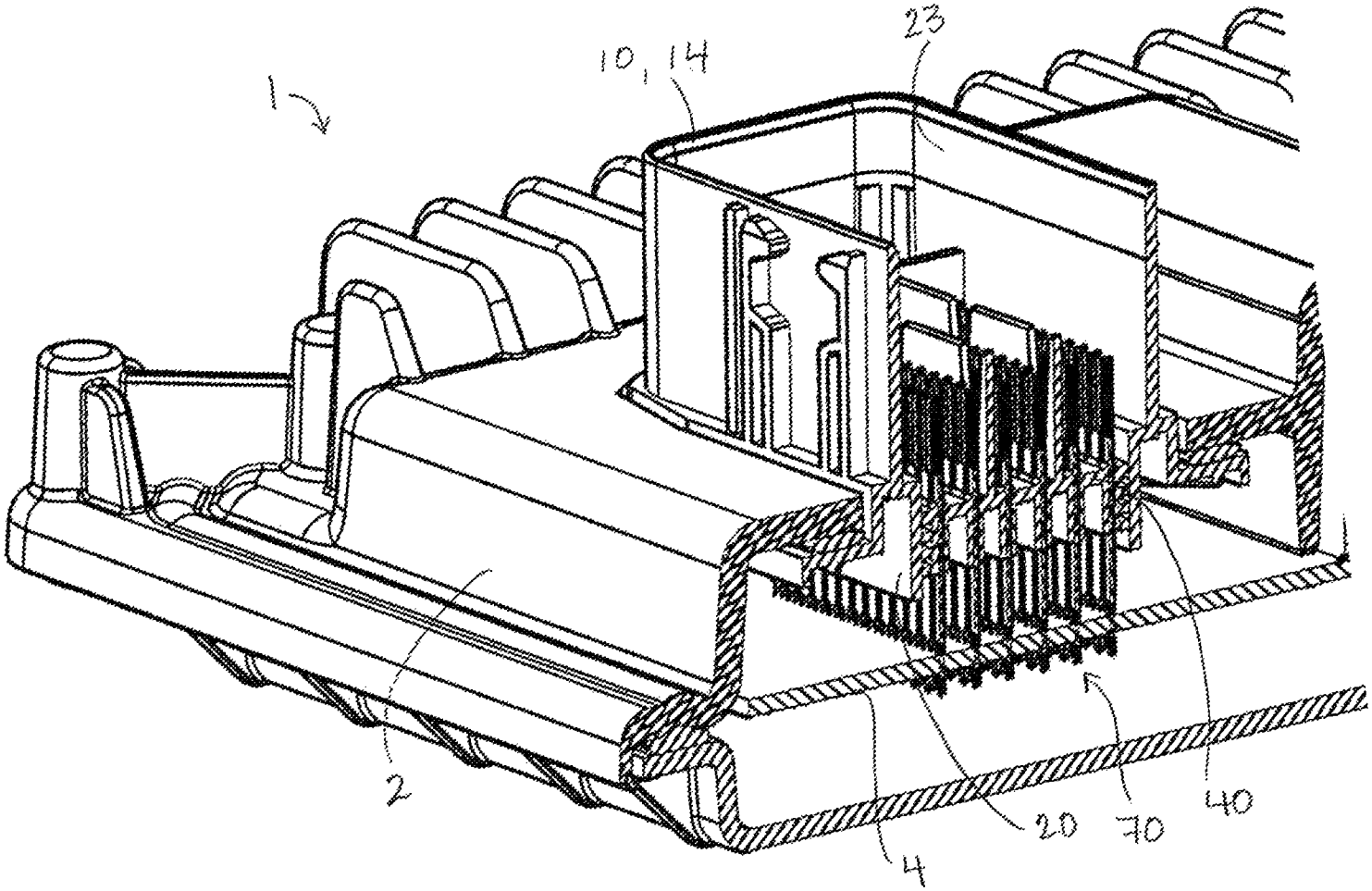
FIG. 1 is a cross sectional view of a portion of an electronic control device including a hybrid electrical connector.
Figure 2:
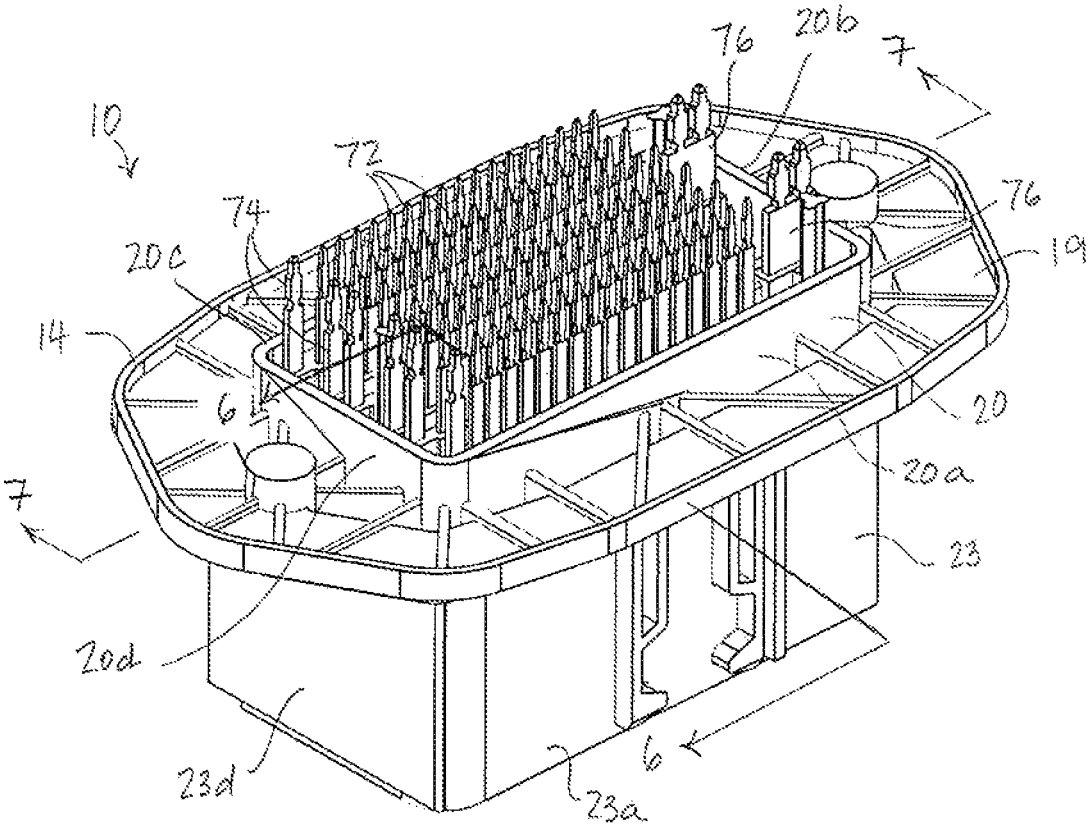
FIG. 2 is a top perspective view of the hybrid electrical connector of FIG. 1.
Figure 3:
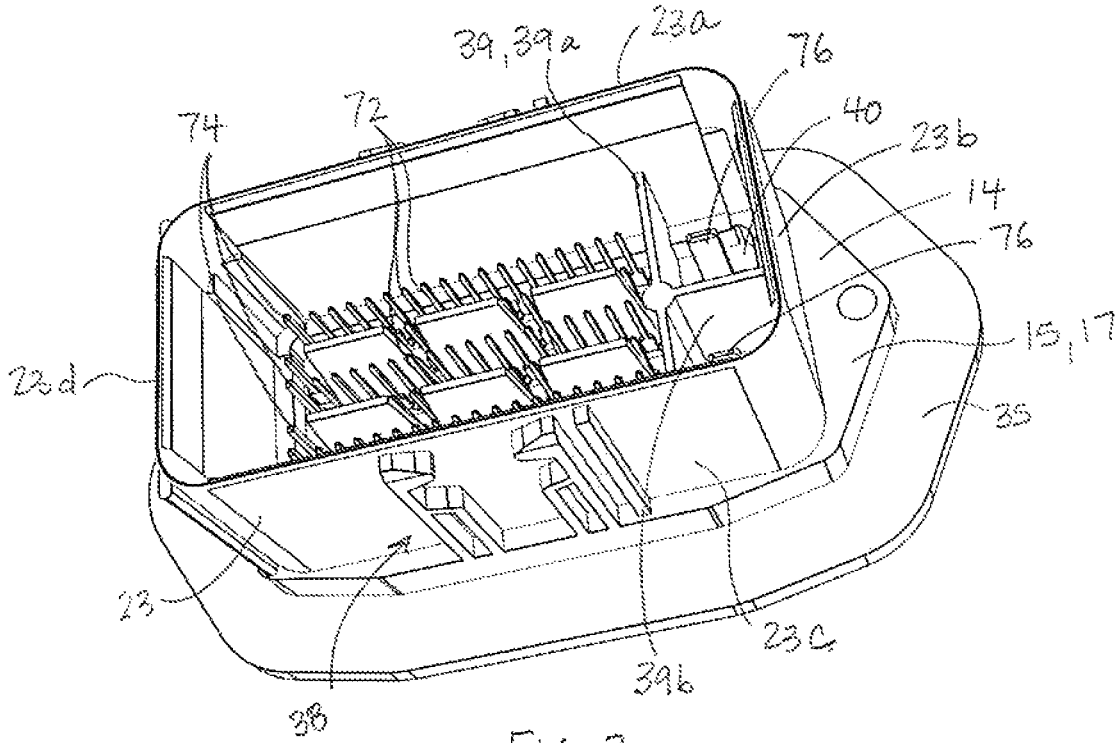
FIG. 3 is a bottom perspective view of the hybrid electrical connector of FIG. 1.
Figure 4:
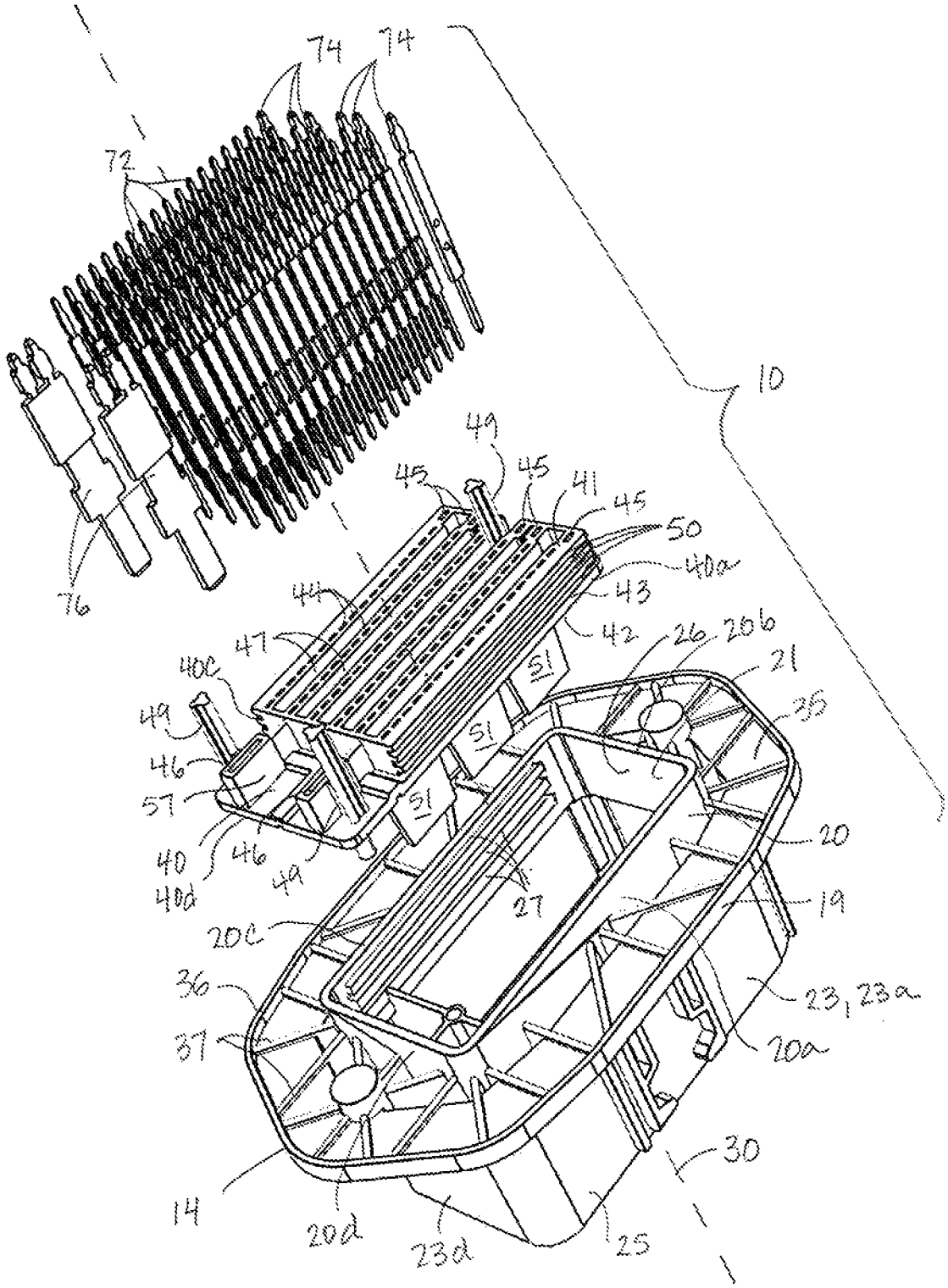
FIG. 4 is an exploded top perspective view of the hybrid electrical connector of FIG. 1.
Figure 5:
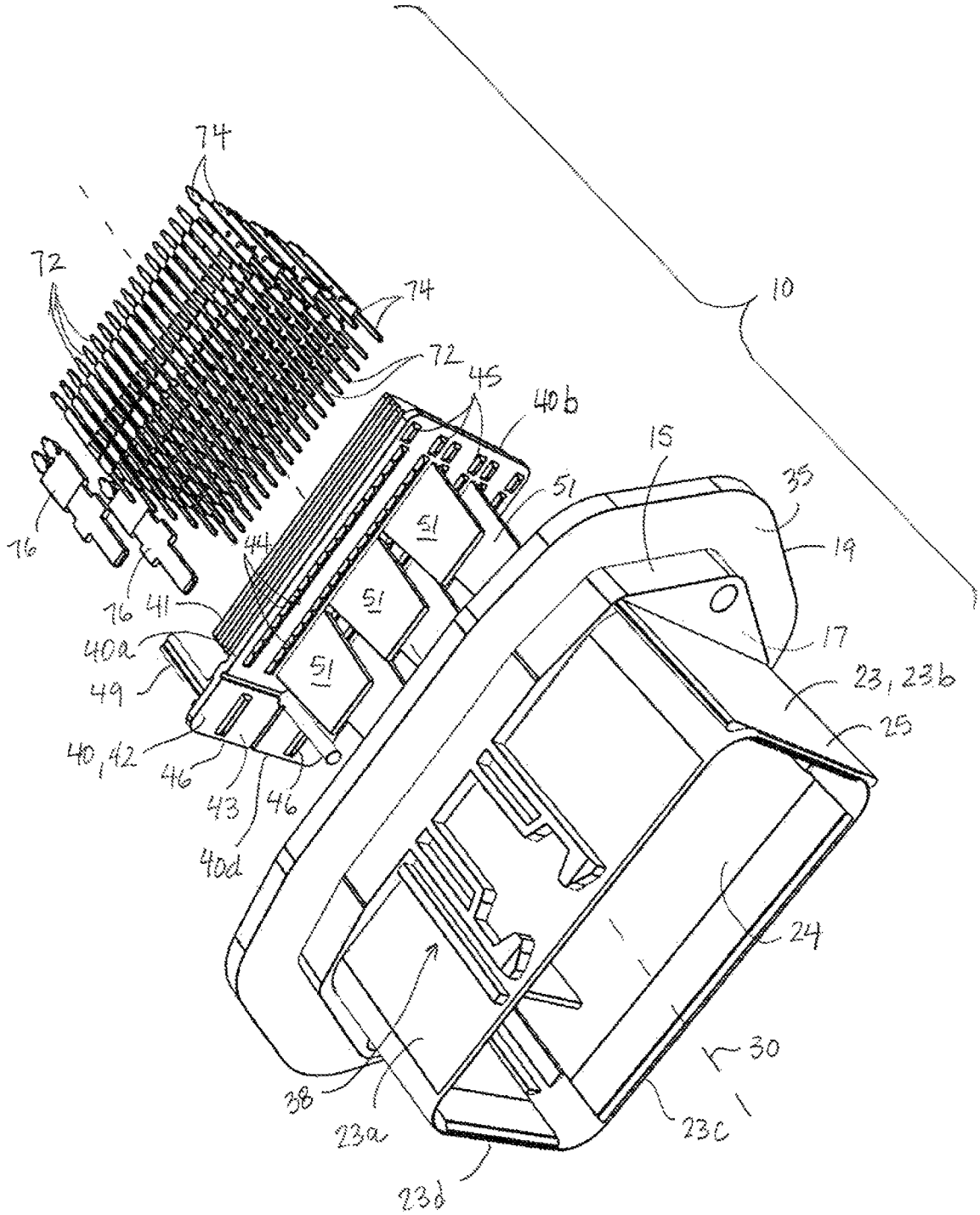
FIG. 5 is an exploded bottom perspective view of the hybrid electrical connector of FIG. 1.
Figure 6:
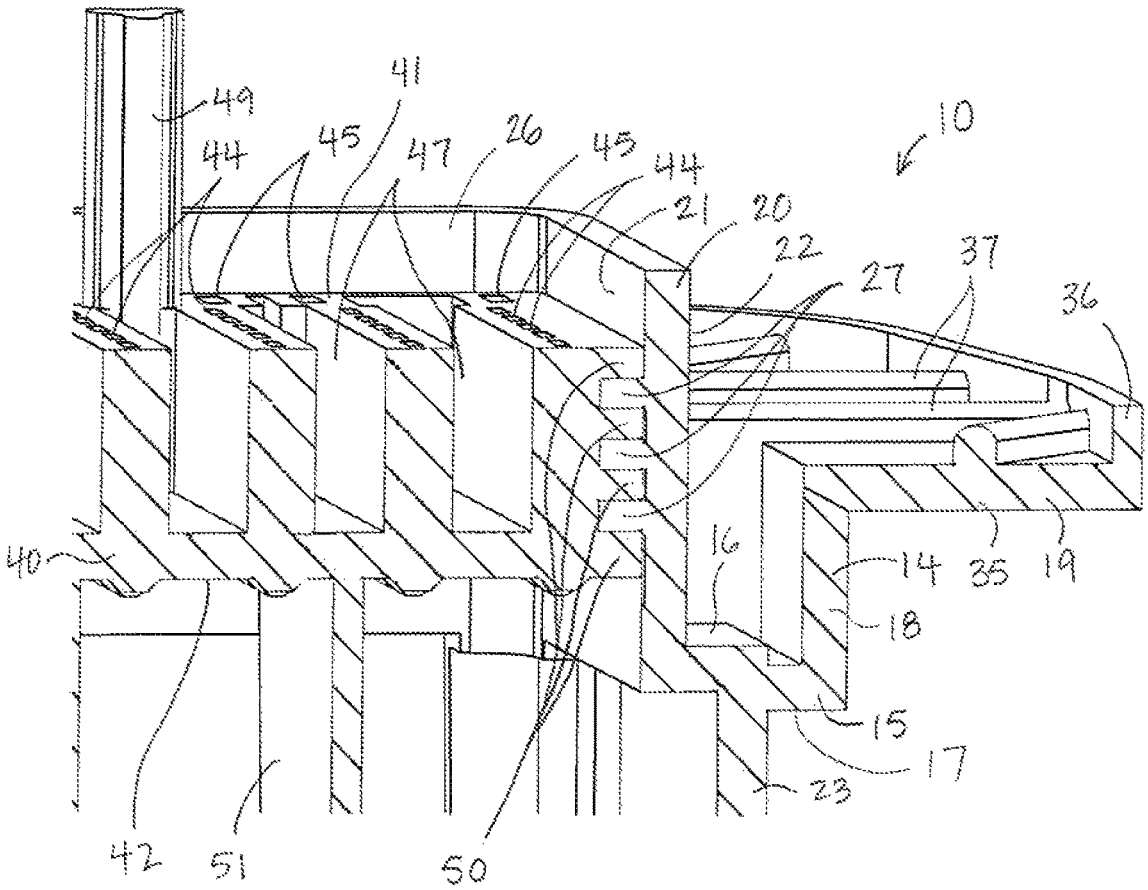
FIG. 6 is a cross sectional view of an enlarged portion of the hybrid electrical connector of FIG. 1 as seen along line 6-6 of FIG. 2, with the pins and potting material omitted for clarity.

Referring to FIGS. 1-7, a hybrid electrical connector 10 may be used to provide an electrical connection, for example between a printed circuit board 4 disposed in a housing 2 of an electronic control device 1 and an electronic circuit of a vehicle communication bus and/or a vehicle control circuit. The connector 10 includes a housing 14 formed of a first plastic material, and a carrier plate 40 that is supported within the housing 14 and is formed of a second plastic material. In addition, the connector 10 includes electrically conductive contacts in the form of elongated, linear pins 72, 74, 76. The pins 72, 74, 76 are supported within the connector 10 by the carrier plate 40, which includes three arrays of holes 44, 45, 46 that receive and support three variants of the pins 72, 74, 76. The connector 10 also includes a sealing layer 82 that overlies at least one surface of the carrier plate 40 (FIG. 6). The sealing layer 82 is formed of a third plastic material that serves as a potting material, and is used to secure the pins 72, 74, 76 within pin holes 44, 45, 46 formed in the carrier plate 40, and to secure the carrier plate 40 to the housing 14, as discussed in detail below. In addition, the connector 10 includes mechanical features that are used further securely retain the carrier plate 40 within the central opening 26 of the housing 14, as discussed in detail below.

The housing 14 of the connector 10 includes a base portion 15 that includes a central opening 26, a tubular first shroud 20 that protrudes outward from a first side 16 of the base portion 15 and surrounds the central opening 26, and a tubular second shroud 23 that protrudes from a second, opposed side 17 of the base portion 15.

The housing base portion 15 is generally planar and elongated. In addition, the central opening 26 is generally rectangular and oriented such that the central opening 26 is elongated in the same direction as the base portion 15. A longitudinal axis 30 of the connector 10 extends in a direction normal to the base portion first side 16 and passes through a center of the central opening 26.

The first shroud 20 has the shape of a rectangular tube and protrudes outward from the base portion first side 16 in a direction parallel to the longitudinal axis 30. The first shroud 20 is concentric with the central opening 26, and an inner surface 21 of the first shroud 20 is aligned with the base portion edge that defines the central opening 26. The first shroud 20 includes a pair of long sides 20*a*, 20*c* connected at each end by a pair of short sides 20*b*, 20*d*. The long sides 20*a*, 20*c* of the first shroud 20 are parallel to the direction of elongation of the base portion 15 and the central opening 26. Elongated housing connector ribs 27 protrude inward from an inner surface 21 of the first shroud 20. For example, in the illustrated embodiment, three parallel, spaced housing connector ribs 27 extend circumferentially (e.g., perpendicular to the longitudinal axis 30) along the short sides 20*b*, 20*d* of the first shroud 20. The housing connector ribs 27 are used to engage corresponding carrier plate connector ribs 50 formed on the carrier plate 40, as discussed below.

The base portion 15 includes a flange 19 that is offset relative to the base portion first side 16 so as to surround the first shroud 20. The flange 19 includes a planar portion 35 that resides in a plane parallel to the base portion 15 and is connected to the base portion 15 via a riser 18 that extends longitudinally from a periphery of the base portion 15. The flange 19 further includes a lip 36 that protrudes longitudinally from the periphery of the planar portion 35 and reinforcing ribs 37 extend between the lip 36 and an outer surface 22 of the first shroud 20.

The second shroud 23 has the shape of a rectangular tube and protrudes outward from the base portion second side 16 in a direction parallel to the longitudinal axis 30. The second shroud 23 is concentric with the central opening 26, and an inner surface 24 of the second shroud 23 is radially outwardly offset relative to the base portion edge that defines the central opening 26. The second shroud 23 includes a pair of long sides 23*a*, 23*c* connected at each end by a pair of short sides 23*b*, 23*d*. The long sides 23*a*, 23*c* of the second shroud 23 are parallel to the direction of elongation of the base portion 15 and the central opening 26. In some embodiments, an outer surface 25 of the second shroud 23 includes surface features 38 that are configured to permit interlocking engagement with an external device that facilitates connection with a larger assembly (not shown).

In addition, a T-shaped brace 39 is disposed both within the central opening 26 and the second shroud 23. The brace 39 includes a plate-shaped first leg 39*a* that extends between the long sides 23*a*, 23*c*, and is parallel to, and spaced apart from, the short sides 23*b*, 23*d*. The brace 39 includes a plate-shaped second leg 39*b* that extends between the first leg 39*a* and one of the short sides, for example, short side 23*b*. The first and second legs 39*a*, 39*b* are formed integrally with the second shroud inner surface 24. The first leg 39*a* is disposed between the short side 23*b* and a midpoint of the second shroud 23, whereby the brace 39 is disposed at one end of the central opening 26. The brace 39 provides a seat and/or structural support for the carrier plate 40, and edges of the brace 39 are received in a corresponding T-shaped groove 52 formed in the carrier plate 40.

The carrier plate 40 is a generally rectangular plate having a first surface 41, and a second surface 42 opposed to the first surface 41 and joined to the first surface 41 by a peripheral edge 43. The carrier plate 40 includes a pair of long sides 40*a*, 40*c* joined at each end by a pair of short sides 40*b*, 40*c*. The carrier plate 40 is disposed in the central opening 26 and is oriented so that the first and second surfaces 41, 42 are perpendicular to the longitudinal axis 30.

The carrier plate 40 is used to reliably and accurately support electrically conductive pins 72, 74, 76 in a predetermined arrangement. As previously mentioned, the connector 10 includes three pin variants. Thus, the carrier plate 40 includes three arrays of holes 44, 45, 46 that receive and support the pins 72, 74, 76, each array corresponding to one of the pin variants. In particular, the carrier plate 40 includes a first array of holes 44 that extend between the first surface 41 and the second surface 42. The holes 44 of the first array are arranged in rows that extend in parallel to the carrier plate long sides 40*a*, 40*c*. The rows are spaced apart in a direction perpendicular to the carrier plate long sides 40*a*, 40*c*, and an elongated channel 47 is formed in the carrier plate first surface 41 between each pair of adjacent rows. The channels 47 reflect removal of unused material from the carrier plate first surface 41, whereby the carrier plate 40 is made lighter in weight and material costs are reduced relative to a carrier plate having no channels between adjacent rows. The holes 44 of the first array are sized and dimensioned to receive pins 72 of the first pin variant, as discussed further below. In the illustrated embodiment, within the first array, there are 104 holes 44 arranged in six rows.

The carrier plate 40 includes a second array of holes 45 that extend between the first surface 41 and the second surface 42. The holes 45 of the second array are arranged in a single row that is disposed adjacent one short side 40*b* of the carrier plate 40 and extends in parallel to the carrier plate short side 40*b*. In addition, the holes 45 of the second array are disposed between the first array of holes 45 and the one short side 40*b* of the carrier plate 40. The holes 45 are spaced apart, and a portion of one the channels 47 extends into the space between each adjacent hole 45. The holes 45 of the second array are sized and dimensioned to receive pins 74 of the second pin variant, as discussed further below. In the illustrated embodiment, within the second array, there are six holes 44 arranged in one row.

The carrier plate 40 includes a third array of holes 46 that extend between the first surface 41 and the second surface 42. The holes 46 of the third array are arranged in a single row that is disposed adjacent the other short side 40*d* of the carrier plate 40 and extends in parallel to the other carrier plate short side 40*d*. In addition, the holes 46 of the third array are disposed between the first array of holes 45 and the other short side 40*d* of the carrier plate 40. The holes 46 are spaced apart along the row. In addition, a recess 57 is formed in the carrier plate first surface 41 between and surrounding adjacent holes 46. The recess 57 reflects removal of unused material from the carrier plate first surface 41, whereby the carrier plate 40 is made lighter in weight and material costs are reduced relative to a carrier plate having no recess. The holes 46 of the third array are sized and dimensioned to receive pins 76 of the third pin variant, as discussed further below. In the illustrated embodiment, within the third array, there are two holes 46 arranged in one row.

Stand offs 49 are provided on the carrier plate 40 that are used to support a printed circuit board (not shown) in a spaced, parallel position relative to the carrier plate first surface 41. The stand offs 49 protrude outward in a direction normal the carrier plate first surface 41. In the illustrated embodiment, a first stand off 49 is disposed within a channel 47 adjacent the one short side 40*b* of the carrier plate 40, and a second and a third stand off 49 are each disposed within the recess 57 adjacent the other short side 40*d* of the carrier plate 40. The second and third stand offs 49 are each disposed between one of the holes 46 and a long side 40*a*, 40*c* of the carrier plate 40. Each standoff 49 includes a proximal end that is integrally formed with the carrier plate, and a distal end that is opposed to the proximal end and resides outside the channel or recess. Each stand off 49 has sufficient length (e.g., a distance between proximal and distal ends) such that the distal end resides outside the first shroud 20, whereby the printed circuit board is supported adjacent the first shroud 20 and in a spaced relationship relative to the first shroud 20.

The carrier plate 40 includes guide elements 51 that protrude outward from the carrier plate second surface 42 in a direction normal to the carrier plate second surface 42. The guide elements 51 are elongated in a direction parallel to the carrier plate long sides 40*a*, 40*c*, and are disposed between adjacent rows of the first array.

In addition, the carrier plate second surface includes a shallow T-shaped groove that provides a seat for the brace 39 when the carrier plate 40 is assembled with the housing 14.

The carrier plate 40 is shaped and dimensioned so that the carrier plate peripheral edge 43 faces and abuts the central opening 26 and the first shroud inner surface 21. In addition, the carrier plate 40 includes carrier plate connector ribs 50 that protrude outward from the carrier plate peripheral edge 43. In the illustrated embodiment, the carrier plate 40 includes four carrier plate connector ribs 50 that protrude outward from the peripheral edge 43. The carrier plate connector ribs 50 are disposed on each of the opposed long sides 40*a*, 40*c* of the carrier plate 40 and extend along a circumference of the carrier plate 40. The carrier plate connector ribs 50 are shaped and dimensioned to engage with the housing connector ribs 27. The engagement between the carrier plate connector ribs 50 and the housing connector ribs 27 serves to locate and retain the carrier plate 40 in a desired position relative to the housing 20.

The connector 10 includes the following three pin variants: The pins 72 of the first pin variant are referred to as "mini pins" and are each an elongated, linear, electrically conductive pin. In the illustrated embodiment, the mini pins 72 have contact end cross-sectional dimensions of 0.5 mm×0.5 mm. Each pin 72 of the first pin variant is disposed in a corresponding one of the holes 45 of the first array. The pins 74 of the second pin variant are referred to as "signal pins" and are each an elongated, linear, electrically conductive pin. In the illustrated embodiment, the signal pins 72 have contact end cross-sectional dimensions of 0.64×0.64 mm. Each pin 74 of the second pin variant is disposed in a corresponding one of the holes 46 of the second array. In addition, the pins 76 of the third pin variant are referred to as "power pins" and are each an elongated, linear, electrically conductive pin. In the illustrated embodiment, the power pins 72 have contact end cross-sectional dimensions of 0.8 mm×0.8 mm, and terminal end cross-sectional dimensions of 0.8 mm×2.8 mm. Each pin 76 of the third pin variant is disposed in a corresponding one of the holes 46 of the third array.

The pins 72, 74, 76 are sufficiently long to pass through the respective hole 44, 45, 46 in which they reside. In the illustrated embodiment, one end of each pin 72, 74, 76 is disposed outside the carrier plate 40 so as to overlie and be spaced apart from the carrier plate first side 41, while the opposed end of each pin 72, 74, 76 is disposed outside the carrier plate 40 so as to overlie and be spaced apart from the carrier plate second side 42.

Figure 7:
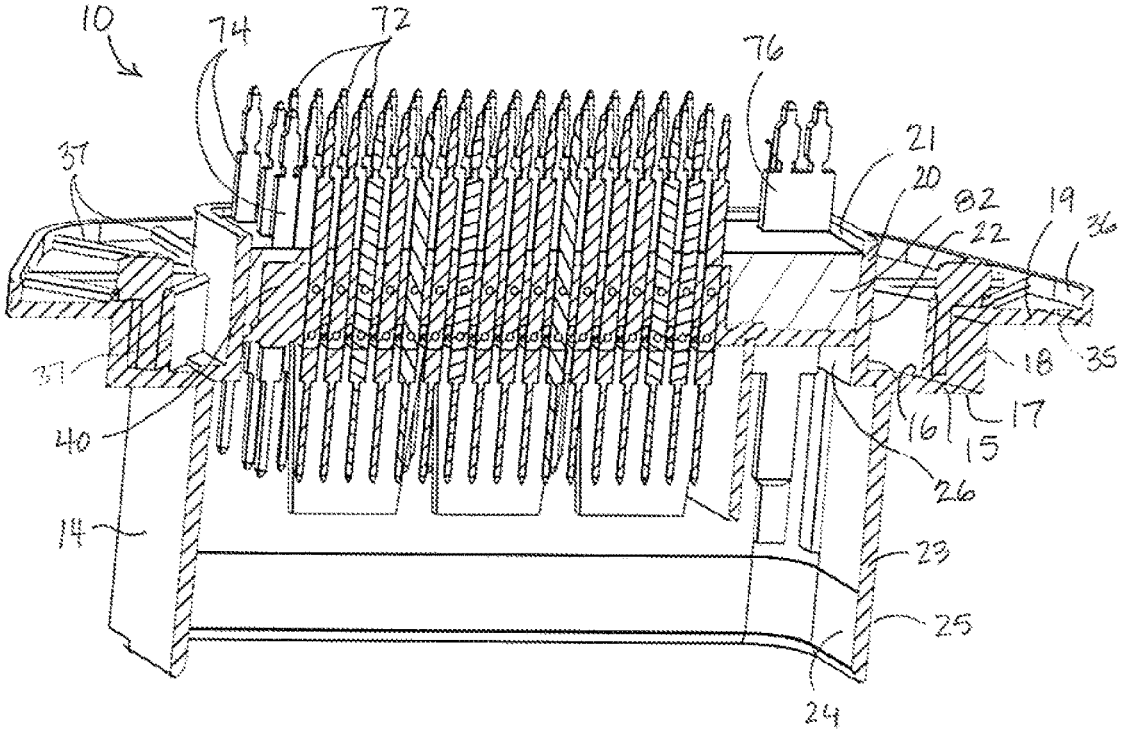
FIG. 7 is a cross-sectional view of the hybrid electrical connector of FIG. 1 as seen along line 7-7 of FIG. 2.

Referring to FIG. 7, the connector 10 includes the sealing layer 82 that overlies at least one surface of the carrier plate 40. In the illustrated embodiment, the sealing layer 82 is disposed in the first shroud 20 and overlies the carrier plate first surface 41 in such a way as to secure the carrier plate 40 to the housing 14, and also to secure the pins 72, 74, 76 within the corresponding holes 44, 45, 46. In particular, the sealing layer 82 is used to pot the pins 72, 74, 76 within the corresponding holes 44, 45, 46, and to pot the carrier plate 40 within the housing 14.

Figure 8:
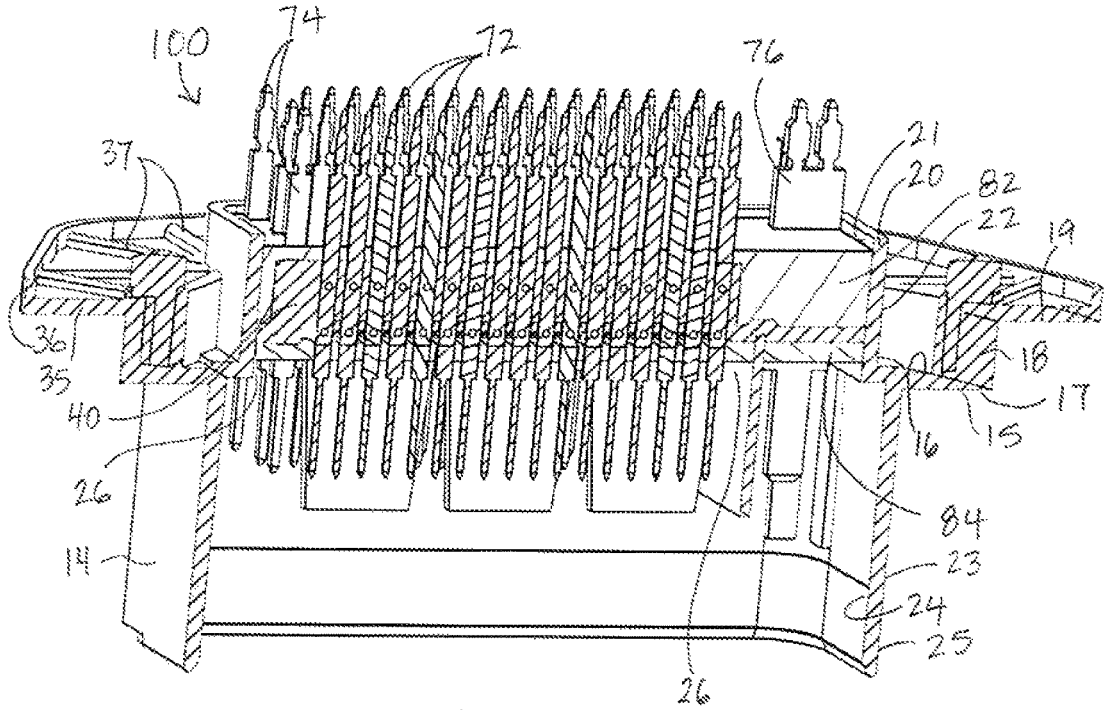
FIG. 8 is a cross-sectional view of an alternative embodiment hybrid electrical connector as seen along line 7-7 of FIG. 2.

Referring to FIG. 8, the connector 10 is not limited to including a sealing layer 82 on one surface (e.g., the first surface 41) of the carrier plate 40. For example, an alternative connector 100 includes the sealing layer 82 that is disposed in the first shroud 20 and overlies the carrier plate first surface 41. In addition, the connector 100 includes a second sealing layer 84 that is disposed in the first shroud 20 and overlies the carrier plate second surface 42 in such a way as to further secure the earner plate 40 to the housing 14, and also to further secure the pins 72, 74, 76 within the corresponding holes 44, 45, 46.

The housing 14, including the base portion 15, the first shroud 20 and the second shroud 23, are formed of a first material. In some embodiments, the housing 14 is formed of a conventional semi-crystalline plastic material, for example a "mid-grade" plastic material, that is selected for toughness, durability and relatively low cost. In one example, the housing 14 may be formed of polyamide 6 with 30 percent fiber glass reinforcement (PA6-GF30). The PA6-GF30 may have water absorption properties of about 2 percent, and may have a volumetric shrinkage of about 0.7 percent. It may also have a Young's modulus of about 8 GPa to 10 GPa, and a yield strength of about 145 MPa. In another example, the housing 14 may be formed of polyamide 6 with 50 percent fiber glass reinforcement (PA6-GF50). In yet another example, the housing 14 may be formed of polybutylene terephthalate with 30 percent glass fiber reinforcement PBT-GF30.

The carrier plate 40 is formed of a second material that is different than the first material. The second material is a semi-crystalline plastic material that has properties that make it more dimensionally stable than the first plastic material. For example, the carrier 40 may be formed of a plastic material that has been engineered to be highly dimensionally stable. For example, the carrier plate may be formed of polyphenylene (PPS). The highly dimensionally stable plastic material may have water absorption properties of less than about 0.05 percent, and may have a volumetric shrinkage of less than about 0.003 cm/cm. The highly dimensionally stable plastic material may also have a Young's modulus (E) of 16 GPa or more, and a yield strength (tensile) of greater than about 130 MPa. Other examples of such highly dimensionally stable materials include polyphthalamide (PPA), high performance polyphthalamide (HPPA), and polyimide (PI).

Thus, the second material used to form the carrier plate 40 is a highly dimensionally stable plastic so that the pins 72, 74, 76 are accurately and reliably supported within the connector 10 in the desired positions and orientations. Moreover, the pins 72, 74, 76 are positionally stable and pin tips are accurately located. The housing 14, whose dimensional stability is less critical, may be formed of a less expensive plastic.

In some embodiments, the first plastic material and the second plastic material have different chemical compositions which make them difficult to bond together. For this reason, the connector 10 includes features that facilitate secure joining of the carrier plate 40 to the housing 14. In particular, the connector 10 includes the sealing layer that 82 that is formed of a third plastic material and is used to secure the pins 72, 74, 76 within the carrier plate holes 44, 45, 46 and to secure the carrier plate 40 to the housing 14, as discussed further below. In addition, the carrier plate 40 and the housing 14 include the connecting ribs 27, 50 which cooperate to locate the carrier plate 40 relative to the housing 14, and also retain the carrier plate 40 within the central opening 26.

The sealing layer 82 is formed of a third material that is different than both the first plastic material and the second plastic material. For example, the sealing layer 82 may be formed of a copolyamide hot melt resin such as is sold under the trademark Thermelt® 865 and fabricated by Bostik TRL s.a. of Privas Cedex, France. The sealing layer 82 is selected to have a fast setting time, good wetting properties at application temperatures and good heat resistance. The sealing layer 82 serves as a potting material and sealant. As used herein, the term "potting" refers to a process of filling at least a portion of an electronic assembly with a solid or gelatinous compound. Although potting is typically used to provide resistance to shock and vibration, and to provide a barrier that protects electronic components from moisture and/or corrosive agents, the sealing layer 82 is also used herein as a potting agent for the purpose of enhancing the interconnection between assembly components and to retain the assembly components in desired relative positions.

Figure 9:
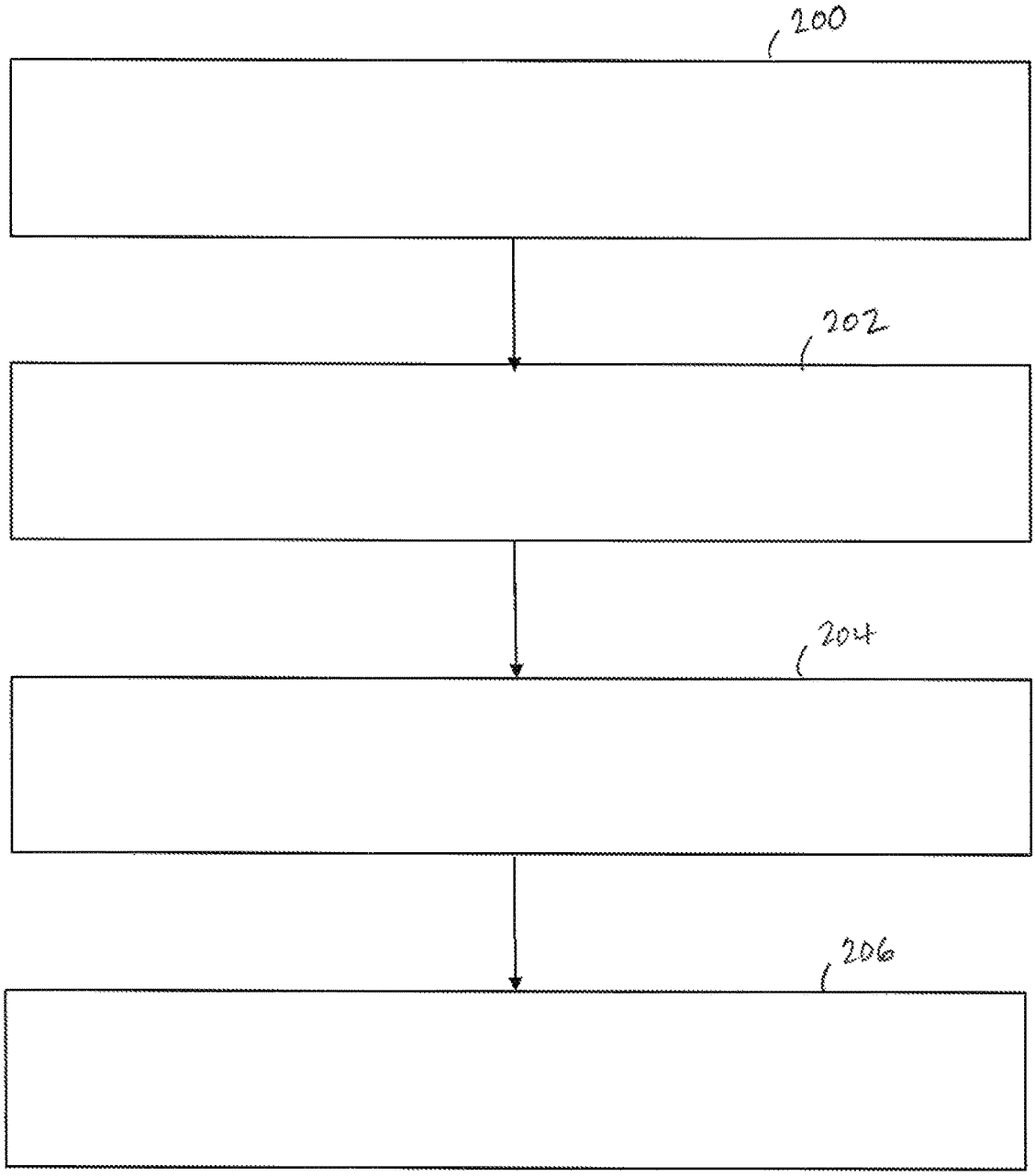
FIG. 9 is a flow chart illustrating a method of manufacturing the hybrid electrical connector of FIG. 1.

Referring to FIG. 9, the hybrid electrical connector 10 can be manufactured using overmolding methods. For example, in a first overmolding method, the electrically conductive pins 72, 74, 76 to be included in the connector 10 are arranged in a jig (not shown) that holds the pins 72, 74, 76 in the desired configuration (step 200). In particular, the jig holds the pins 72, 74, 76 in the parallel and spaced apart configuration that corresponds the arrangement of the holes 44, 45, 46 employed in the carrier plate 40.

Once the pins 72, 74, 76 are secured in the desired configuration within the jig, the jig is placed in a first overmolding apparatus (not shown) that includes tooling and materials configured to form the carrier plate about the pins 72, 74, 76. A first overmolding procedure is performed on the pins 72, 74, 76 within the first overmolding apparatus (step 202). The first overmolding procedure produces the carrier plate 40 with the pins molded in place in the desired configuration. The second material is used in the first overmolding procedure whereby the carrier plate 40 is formed of the second plastic material that reliably and securely supports the pins 72, 74, 76 in the desired configuration.

Following the first overmolding procedure, the carrier plate 40 and pins 72, 74, 76 are removed from the first overmolding apparatus and placed in a second overmolding apparatus (not shown) that includes tooling and materials configured to form the housing 14 about the carrier plate 40. A second overmolding procedure is performed on the carrier plate 40 within the second overmolding apparatus (step 204). The second overmolding procedure produces the housing 14 with the carrier plate 40 and pins 72, 74, 76 molded in place in the desired configuration. In particular, the housing 14 is formed having housing connector ribs 27 that are in engagement with the corresponding carrier plate connector ribs 50 formed on the carrier plate 40. The first material is used in the second overmolding procedure whereby the housing 14 is formed of the first plastic material that supports the carrier plate 40 within the central opening 26.

Once the housing 14 has been formed on the carrier plate 40, the assembly including the housing 14, carrier plate 40 and pins 72, 74, 76 is removed from the second overmolding apparatus and, a sealing layer 82 is applied to at least one side of the carrier plate 40 (step 206). For example, the sealing layer 82 is applied to the first surface 41 of the carrier plate 40. During the application, the sealing layer 82 flows into the channels 47 and recess 57, and substantially fills the space defined by the first shroud inner surface 21 and the carrier plate first surface 41. Once cured, the sealing layer acts as a potting material that seals the pins 72, 74, 76 to the carrier plate 40, and seals the carrier plate 40 to the housing 14.

In the first method, the connector is formed using multiple, single injections ("shots"), each shot being performed in its own overmolding apparatus. Since the carrier 40 is moved between the first and second apparatuses between overmolding steps, some cooling of the carrier 40 occurs before the second overmolding procedure, whereby it becomes more difficult to form a chemical bond directly between the first and second materials. For this reason, the connector 10 employs securing features, including the mechanical connection between the carrier plate 40 and the housing 14 provided by the connecting ribs 27, 50, as well as the sealing layer 82 used to form a chemical connection between the carrier plate 40 and the housing 14, and between the pins 72, 74, 76 and the carrier plate 40, that ensure the integrity of the connector 10 even when formed of multiple different plastic materials.

A second overmolding method is similar to the first overmolding method described above. The second overmolding method differs from the first overmolding method in that it provides two "shots" in a single overmolding apparatus, as will now be described.

In the second overmolding method, the electrically conductive pins 72, 74, 76 to be included in the connector 10 are arranged in a jig (not shown) that holds the pins 72, 74, 76 in the desired configuration (step 200). In particular, the jig holds the pins 72, 74, 76 in the parallel and spaced apart configuration that corresponds the arrangement of the holes 44, 45, 46 employed in the carrier plate 40.

Once the pins 72, 74, 76 are secured in the desired configuration within the jig, the jig is placed in an overmolding apparatus (not shown) that includes tooling and materials configured to form the carrier plate 40 about the pins 72, 74, 76, and also includes tooling a materials configured to form the housing about the carrier plate 40. A first overmolding procedure is performed on the pins 72, 74, 76 within the first overmolding apparatus (step 202). The first overmolding procedure produces the carrier plate 40 formed of the second material with the pins molded in place in the desired configuration. Immediately following the first overmolding procedure, and without removing the carrier plate 40 from the overmolding apparatus, a second overmolding procedure is performed on the carrier plate 40 (step 204). The second overmolding procedure produces the housing 14 formed of the first material with the carrier plate 40 and pins 72, 74, 76 molded in place in the desired configuration. Because the time delay between the first and second overmolding procedures is minimal, the second material is still relatively hot during the second overmolding procedure. As a result, some blending and/or bonding of the first and second materials may occur, further increasing the structural integrity of the finished connector 10.

In the second overmolding method, the sealing layer 82 is applied. In particular, once the housing 14 has been formed on the carrier plate 40, a sealing layer 82 is applied to at least one side of the carrier plate 40 (step 206). The sealing layer 82 may be applied within the overmolding apparatus, or in a separate apparatus. During the application, the sealing layer 82 flows into the channels 47 and recess 57, and substantially fills the space defined by the first shroud inner surface 21 and the carrier plate first surface 41. Once cured, the sealing layer acts as a potting material that seals the pins 72, 74, 76 to the carrier plate 40, and seals the carrier plate 40 to the housing 14.

Like the first method, the second method provides the connector 10 that employs securing features, including the mechanical connection between the carrier plate 40 and the housing 14 provided by the connecting ribs 27, 50, as well as the sealing layer 82 used to form a chemical connection between the carrier plate 40 and the housing 14, and between the pins 72, 74, 76 and the carrier plate 40, that ensure the integrity of the connector 10 even when formed of multiple different plastic materials.

A third overmolding method is similar to the first overmolding method described above. The third overmolding method differs from the first overmolding method in that it provides the pins 72, 74, 76 to the connector as a later manufacturing step rather than as an initial manufacturing step. In particular, the pins 72, 74, 76 are applied to the overmolded subassembly that includes the housing 14 overmolded onto the carrier plate 40 using a stitching technique. Once the pins 72, 74, 76 have be stitched into the corresponding holes 44, 45, 46, the sealing layer 82 is applied to at least one side of the carrier plate 40.

Like the first method, the third method provides the connector 10 that employs securing features, including the mechanical connection between the carrier plate 40 and the housing 14 provided by the connecting ribs 27, 50, as well as the sealing layer 82 used to form a chemical connection between the carrier plate 40 and the housing 14, and between the pins 72, 74, 76 and the carrier plate 40, that ensure the integrity of the connector 10 even when formed of multiple different plastic materials.

In the illustrated embodiment, the connector 10 includes three pin variants and three arrays of holes 44, 45, 46 that receive and support the three variants. It is understood, however, that the connector 10 may include a greater or fewer number of pin variants, and that the number of arrays of holes provided in the carrier plate 40 will correspond to the number of pin variants.

In the illustrated embodiment, the number of pins 72 of the first pin variant and the number of holes 44 in the first array is 104, the number of pins 74 of the second pin variant and the number of holes 45 in the second array is six, and the number of pins 76 of the third pin variant and the number of holes 46 in the third array is two. However, it is understood that the number of pins of each variant and the number of holes in the corresponding array may be greater or fewer, and is determined by the requirements of the specific application.

In the illustrated embodiment, the pins 72, 74, 76 of the three pin variants have been described as mini pins, signal pins, and power pins, respectively, and exemplary sizes have been disclosed to illustrate some of the relative differences between the pins of the three variants. However, it is understood that pin variants of other types, sizes and shapes can be used as an alternative to, or in addition to, the exemplary pin variants described herein.

Figure 10:
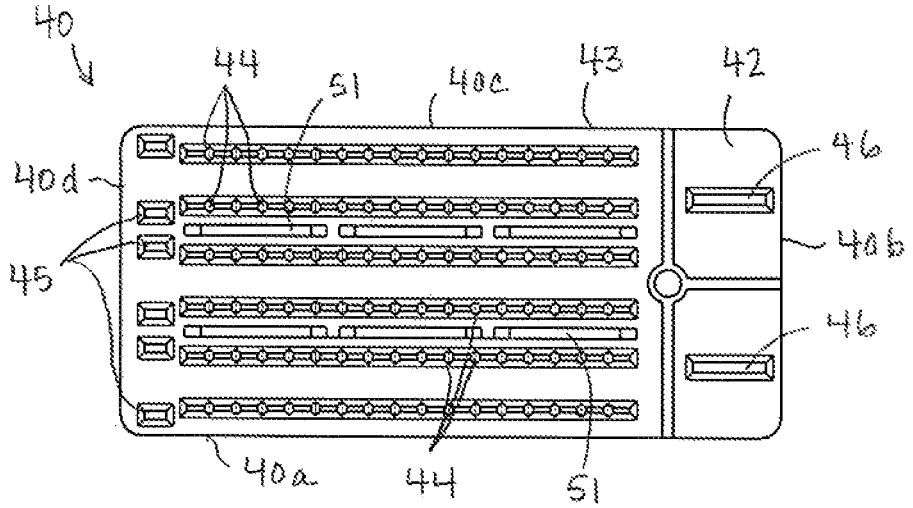
FIG. 10 is a bottom view of the of the hybrid electrical connector of FIG. 1.
Figure 11:
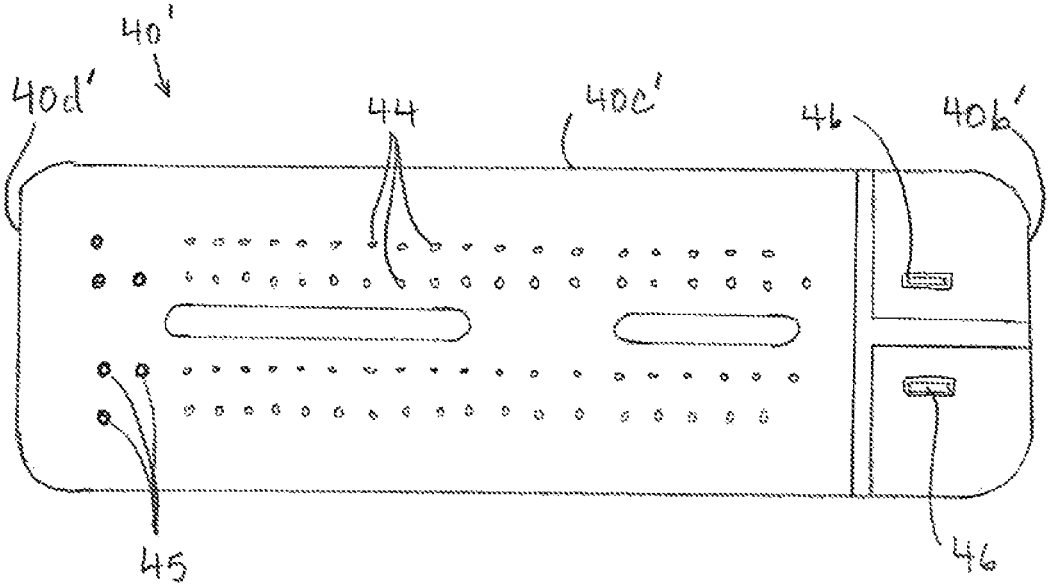
FIG. 11 is a bottom view of an alternative embodiment of the hybrid electrical connector.

Referring to FIG. 10, in the illustrated embodiment, the carrier plate 40 has long sides 40*a*, 40*c* and short sides 40*b*, 40*d* dimensioned to provide a carrier plate in which an aspect ratio of short side to long side is relatively low, for example about 1 to 2. In some embodiments, the relatively low aspect ratio may be beneficial since it may reduce material requirements. However, the connector 10 is not limited to having a carrier plate 40 formed with this aspect ratio. For example, as seen in FIG. 11, an alternative embodiment of the carrier plate 40' is formed having different proportions such that the aspect ratio is about 1 to 3 or 4. In the alternative embodiment connector 100, the three arrays of holes 44, 45, 46 have a different arrangement than the corresponding arrays of the carrier plate 40 of FIG. 10, which may be beneficial in order to address packaging requirements of a specific application.

Selective illustrative embodiments of the electronic control device including an electrical connector are described above in some detail. It should be understood that only structures considered necessary for clarifying the device and connector have been described herein. Other conventional structures, and those of ancillary and auxiliary components of the device and connector, are assumed to be known and understood by those skilled in the art. Moreover, while a working example of the device and connector have been described above, the device and connector are not limited to the working examples described above, but various design alterations may be carried out without departing from the device and connector as set forth in the claims.

What is claimed is:

1. A method of fabricating an electrical connector comprising providing electrically conductive pins arranged in an array in which each pin is spaced apart from and parallel to adjacent pins of the array;

performing a first overmolding procedure on the pins in which a carrier plate is provided, the carrier plate formed of a first plastic material that supports the pins in the arrayed configuration;

performing a second overmolding procedure on the carrier plate in which a housing is provided, the housing formed of a second plastic material and surrounding a periphery of the carrier plate in such a way that an outer periphery of the carrier plate engages an inner periphery of the housing; and following the second overmolding procedure, applying a sealing layer formed of a third plastic material to one side of the carrier plate in such a way as to seal the pins to the carrier plate and seal the carrier plate to the housing.

2. The method of claim 1 wherein the first overmolding procedure is performed in a first apparatus, the second overmolding procedure is performed in a second apparatus, and the carrier plate is transferred between the first apparatus and the second apparatus following the first overmolding procedure, whereby cooling of the carrier plate occurs between the first overmolding procedure and the second overmolding procedure.

3. The method of claim 1 wherein the first over folding procedure and the second overmolding procedure are performed in a first apparatus, and the carrier plate is remains in the first apparatus for both the first overmolding procedure and the second overmolding procedure, and the second overmolding procedure is performed immediately following the first overmolding procedure, whereby a portion of a first material used in the first overmolding procedure forms a chemical bond with a portion of a second material used in the second overmolding procedure.

4. The method of claim 1 wherein the array of pins is provided prior to the step of performing a first overmolding procedure on the pins whereby the carrier plate is formed with the array of pins in place.

5. The method of claim 1 wherein the array of pins is provided following the step of performing a second overmolding procedure on the carrier plate in which a housing is provided, and the pins are inserted into preexisting openings in the carrier plate.

6. A method of fabricating an electrical connector comprising providing electrically conductive pins arranged in an array in which each pin is spaced apart from and parallel to adjacent pins of the array;

performing a first overmolding procedure on the pins in which a carrier plate is provided, the carrier plate formed of a first plastic material that supports the pins in the arrayed configuration;

performing a second overmolding procedure on the carrier plate in which a housing is provided, the housing formed of a second plastic material and surrounding a periphery of the carrier plate in such a way that, an outer periphery of the carrier plate engages an inner periphery of the housing; and following the second overmolding procedure, applying a sealing layer formed of a third plastic material to one side of the carrier plate in such a way as to seal the pins to the carrier plate and seal the carrier plate to the housing, wherein the first overmolding procedure is performed in a first apparatus, the second overmolding procedure is performed in a second apparatus, and the carrier plate is transferred between the first apparatus and the second apparatus following the first overmolding procedure, whereby cooling of the carrier plate occurs between the first overmolding procedure and the second overmolding procedure.

7. A method of fabricating an electrical connector comprising providing electrically conductive pins arranged in an array in which each pin is spaced apart from and parallel to adjacent pins of the array;

performing a first overmolding procedure on the pins in which a carrier plate is provided, the carrier plate formed of a first plastic material that supports the pins in the arrayed configuration;

performing a second overmolding procedure on the carrier plate in which a housing is provided, the housing formed of a second plastic material and surrounding a periphery of the carrier plate in such a way that an outer periphery of the carrier plate engages an inner periphery of the housing; and following the second overmolding procedure, applying a sealing layer formed of a third plastic material to one side of the carrier plate in such a way as to seal the pins to the carrier plate and seal the carrier plate to the housing, wherein the first overmolding procedure and the second overmolding procedure are performed in a first apparatus, and the carrier plate is remains in the first apparatus for both the first overmolding procedure and the second overmolding procedure, and the second overmolding procedure is performed immediately following the first overmolding procedure, whereby a portion of a first material used in the first overmolding procedure forms a chemical bond with a portion of a second material used in the second overmolding procedure.

* * * * *